US006510804B1

(12) United States Patent
Negoro

(10) Patent No.: US 6,510,804 B1
(45) Date of Patent: Jan. 28, 2003

(54) MARKING DEVICE IN PAPER MONEY THEFT PROOF SYSTEM

(76) Inventor: Takashi Negoro, 422, Hata-cho, Kishiwada-shi, Osaka (JP), 596-0831

( * ) Notice: Subject to any disclaimer, the term of this patent is extended or adjusted under 35 U.S.C. 154(b) by 0 days.

(21) Appl. No.: 09/470,984

(22) Filed: Dec. 23, 1999

(30) Foreign Application Priority Data

Dec. 24, 1998 (JP) ..... 10-367188

(51) Int. Cl.[7] ..... E05G 1/00
(52) U.S. Cl. ..... 109/25; 109/32; 109/31
(58) Field of Search ..... 109/25–32, 34

(56) References Cited

U.S. PATENT DOCUMENTS

| | | | | | |
|---|---|---|---|---|---|
| 784,805 | A | * | 3/1905 | Petersen | 109/25 |
| 1,795,564 | A | * | 3/1931 | Korge | 109/25 X |
| 2,035,498 | A | | 3/1936 | Navis et al. | 109/6 |
| 3,344,757 | A | * | 10/1967 | Touyet | 109/25 |
| 3,654,880 | A | * | 4/1972 | Schesso | 109/25 |
| 4,425,853 | A | * | 1/1984 | McGregor et al. | 109/25 |
| 5,598,793 | A | * | 2/1997 | Lopez, Jr. | 109/25 |
| 5,775,235 | A | * | 7/1998 | Lindskog et al. | 109/25 |
| 6,065,408 | A | * | 5/2000 | Tillim et al. | 109/25 |

FOREIGN PATENT DOCUMENTS

| | | |
|---|---|---|
| DE | 2 225 437 | 12/1973 |
| FR | 2 572 907 | 5/1986 |
| JP | 6-108741 | 4/1994 |
| JP | 7-9787 | 1/1995 |

* cited by examiner

*Primary Examiner*—Suzanne Dino Barrett
(74) *Attorney, Agent, or Firm*—Wenderoth, Lind & Ponack, L.L.P.

(57) ABSTRACT

A marking device in a paper money theft proof system can surely provide a mark to stolen paper money so as to alert the public, and can also be used repeatedly, and thus economically. The marking device has a sensor that detects a shock produced when a paper money container is moved or broken to take paper money contained in the paper money container out of it. A marking device provides a mark to at least a part of the paper money under the control of signals from the sensor, the marking device being constructed so as to partially cut the paper money.

14 Claims, 3 Drawing Sheets

MARKING DEVICE IN PAPER MONEY THEFT PROOF SYSTEM

BACKGROUND OF THE INVENTION

1. Field of the Invention

The present invention relates to a marking device in a paper money theft proof system. More particularly, the present invention relates to a marking device for providing a mark to paper money when the paper money in a paper money container, such as an automatic cash dispenser, a safe or an attache case, or the paper money container itself, is stolen, for tracing the stolen paper money.

2. Prior Art

In recent years, along with the popularization of cash card and credit card, automatic cash dispensers (hereinafter it is simply referred to as a "CD machine") have been placed all over the city, at places such as in front of a station, supermarkets and department stores.

The CD machine is so designed as not to permit a withdrawal in cash (paper money) contained in the interior of the CD machine without entering personal information such as a personal identification number. The CD machine is placed in specific room with a security camera(s), so that the paper money contained in the CD machine cannot be stolen with ease even when it is tried to be dishonestly taken from it.

In addition to the security camera being in use during the period of time during which the CD machine is not in operation, the indoor or specific room for the CD machine is locked at its entrance. Various security countermeasures are taken so that when someone tries to break the lock to break into the room without permission, an alarm such as an audible alarm or a silent alarm can be issued to a security company to inform it of the existence of the intruder and the extraordinary event.

However, many of the conventional security countermeasures are based on the premise of the intruder entering the CD machine room from the entrance, so there is a possible fear that the security countermeasures may fail when the intruder breaks the wall or floor and breaks into the room therefrom.

Also, even when the security countermeasures function adequately to issue the audible alarm to convey the alarm to security guards, if the intruder steals the CD machine as a whole in a short time, there is the possibility that the paper money may already be stolen before the security guards rush in.

Security countermeasures are also taken for cash transport using a cash transporting car by the provision of, e.g., a radio transmitter that enables immediate radio contact with the police in case of an emergency.

However, with this type of security countermeasures for cash transport, if the paper money is stolen from the cash transporting car over a short time, as is the case with the CD machine, there is the possibility that the robber(s) may already have run away before the police arrive at the scene.

Thus, the conventional security countermeasures for cash transport have the problem that no matter how the security is reinforced, once the paper money is stolen, it is hard to demonstrate whether paper money being used was stolen or not, so that the robber(s) can put stolen paper money into circulation with no hassle.

Thus, with the conventional security countermeasures, once the robber(s) succeeds in robbing, since it is hard to tell the difference between the stolen paper money and legitimately circulating paper money, the robber(s) can use the stolen paper money with ease.

In addition, since a robber(s) tries to steal the paper money in the shortest possible time, there are increasing tendencies of arms such as guns to be used in stealing the paper money, so that the crimes of a violent and heinous nature are undesirably increasing.

To solve the problems mentioned above, a device has been sought that can be put into action so that when the paper money container itself or the paper moneys contained therein are tried to be taken out by force or violence, the trace and recovery of the stolen paper money can be ensured and facilitated to prevent the stealing of the paper money.

There has been proposed a marking device that can differentiate the paper money robbed or obtained by fraudulent acts, such as destruction of the CD machine or an attack of a cash transport car, in such a manner as to let the public know that fact, and with also can trace the robbed paper money easily to prevent the circulation of the robbed paper money, and thus create a disincentive to rob paper money by violence. As disclosed by, for example, Japanese Patent Laid-open Publications No. Hei 6(1994)-108741 and Hei 7(1995)-9787, there has been proposed a marking device having means for spraying ink onto the paper money contained in a safe or CD machine when they are tried to be forcibly taken out by fraudulent acts.

However, this type of marking device, having a means for spraying ink onto the paper money, has the disadvantage that where the marking device is built in a precision machine, such as the CD machine, the ink sprayed has a negative effect on the CD machine. Specifically, the ink sprayed may cause trouble in the CD machine itself as well as messing the interior of the CD machine. The ink used for the marking device has the property of being hard to remove once it adheres to something, so that once the marking device is put into action to spray the ink, the whole CD machine using such a marking device must be replaced with a new one, which is very expensive.

In addition, even when the ink is sprayed on a cluster of paper money piled with density, it is hard to mark the entirety of the paper money with ink in an identifiable manner. It is probable that paper money in the middle of a pile of paper money may take ink only at the sides thereof. The paper money thus incompletely marked with the ink can be circulated with ease, so there is a possible fear that the marking of the paper money may be meaningless.

SUMMARY OF THE INVENTION

Accordingly, the present invention has been made, aiming to provide a marking device in a paper money theft proof system that can surely provide a mark to paper money that is stolen or obtained by fraudulent acts, such as destruction of the CD machine or attack of a cash transport car, so as to let the public know that fact, and which also can be used repeatedly, and thus economically.

To accomplish the object mentioned above, the present invention provides a marking device in a paper money theft proof system comprising a sensor that detects a shock produced when a paper money container is moved or broken to take out paper money contained in the paper money container. A marking means provides a mark to at least a part of the paper money under control of signals detected by the sensor, the marking means being so constructed as to partially cut the paper money.

The terminology of "paper money" used herein is intended to include, for example, merchandise coupons, exchange tickets, and negotiable securities, in addition to Bank of Japan Notes and Foreign Government Securities.

Also, the terminology of "paper money container" used herein is intended to include a containing part of the CD machine for accommodating cash, a solid box (lock box) for holding the paper money in trust, such as a safe, an attache case used for cash transport, and a cartridge built in these containers for encasing cash.

The expression of "the paper money container is broken" used herein means that a lockage part of the paper money container is broken or a frame or a side wall of the paper money container is broken by cutting or like manner.

The expression of "the paper money container itself is moved" used herein refers to a situation such that, where the paper money container is a cash containing part of the CD machine, the CD machine itself is carried out or taken away.

No particular limitation is imposed on the sensor, as long as it is sensitive to a different shock from the shock generally given to the paper money container. It could be a mercury switch that is sensitive to vibration or tilt or a limit switch that is switched on when the paper money container is moved from its set position.

Further, no particular limitation is imposed on the cutting means, though the cutting means which may be used include a means for cutting a part of the paper money by use of an edged tool, a means for cutting a part of the paper money by use of a heating wire, and a means for boring a hole by use of a sharp-pointed member like a drill or an awl.

In the marking device in the paper money theft proof system, the marking means comprises a cutting blade for partially cutting any side end of the paper money in the paper money container and shifting means for shifting one of the cutting blade and the paper money contained in the paper money container relative to the other in a direction in which the paper money is piled.

In the construction noted above, the cutting blade for cutting a part of the paper money may take any form, including a rotary blade and an edged steel plate, and no particular limitation is imposed on the form of the cutting blade.

Also, the cutting edge of the cutting blade may take any form, including a saw-toothed edge form and a sharp-edged blade form, and no particular limitation is imposed on the form of the cutting edge of the cutting blade.

Further, as long as the shifting means is constructed to allow one of the cutting blade and the paper money to move relative to the other in a direction of the paper moneys being piled, it may allow the cutting blade to move relative to the paper money and vice versa, and no particular limitation is imposed thereon.

The marking device may be provided with two or more cutting blades for cutting the paper money.

In the construction noted above, the cutting blades may be placed in adjoining relation or may alternatively be placed so that they can confront different sides of the paper money, respectively. No particular limitation is imposed on the locations of the cutting blades.

Also, the cutting blades may be so arranged that at least two different sides of the paper money at side end portions thereof can be cut by the cutting blades.

DETAILED DESCRIPTION OF THE EMBODIMENT

With reference to the accompanying drawings, one preferred embodiment of a marking device in a paper money theft proof system in accordance with the present invention will be described below. It is to be understood, however, that the scope of the invention is by no means limited to the illustrated embodiments.

Figure 1:
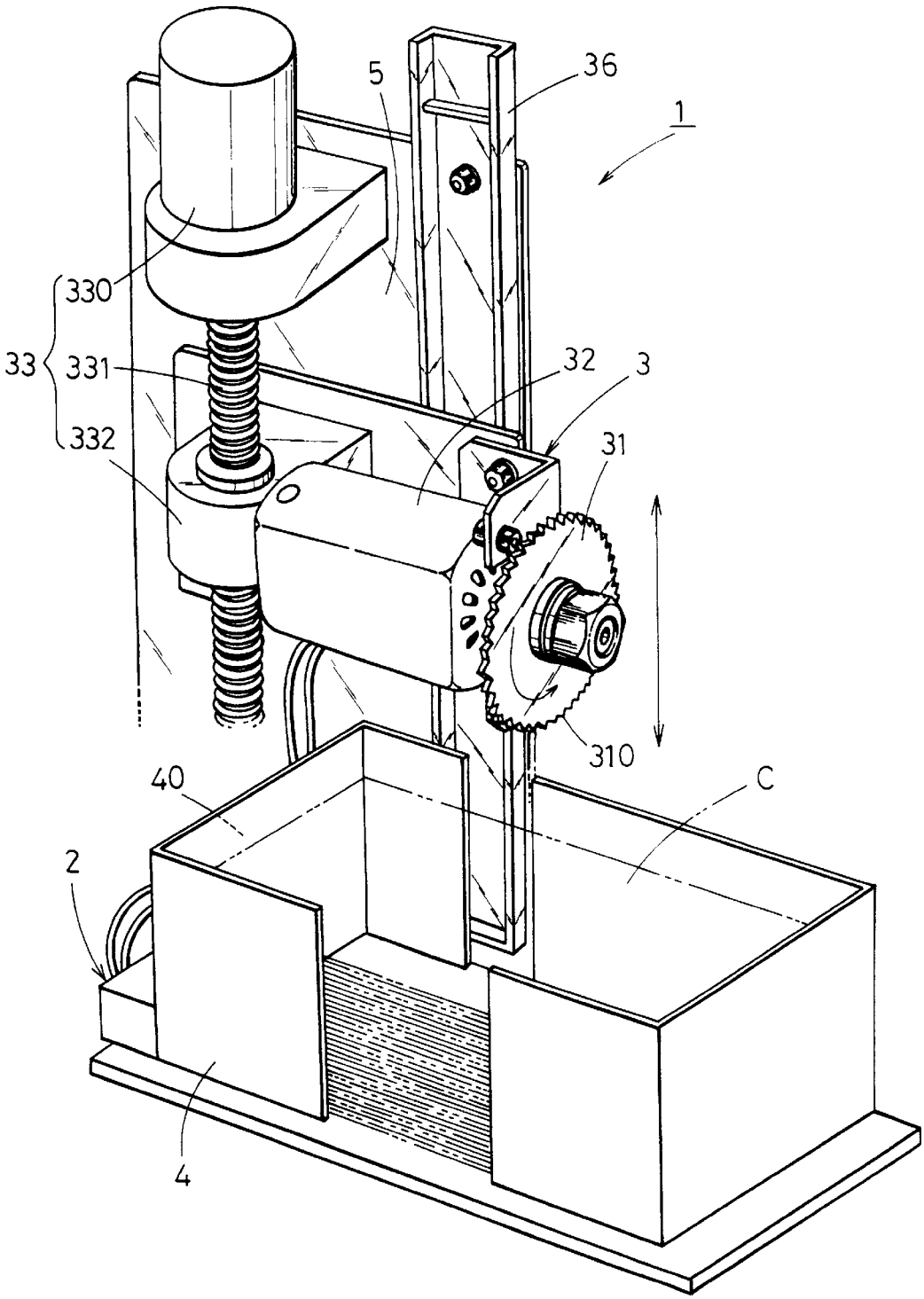
FIG. 1 is a perspective view showing one embodied form of a marking device in a theft proof system in accordance with the present invention.

Referring to FIG. 1, there is shown a perspective view showing one embodied form of a marking device in a paper money theft proof system in accordance with the present invention.

As shown in FIG. 1, the marking device 1 in the paper money theft proof system (hereinafter it is simply referred to as the "marking device") is provided with a sensor 2, marking means 3 and a mounting plate 5 by which the marking device is mounted at a position adjacent to a paper money container 4 of the CD machine (not shown).

Figure 2:
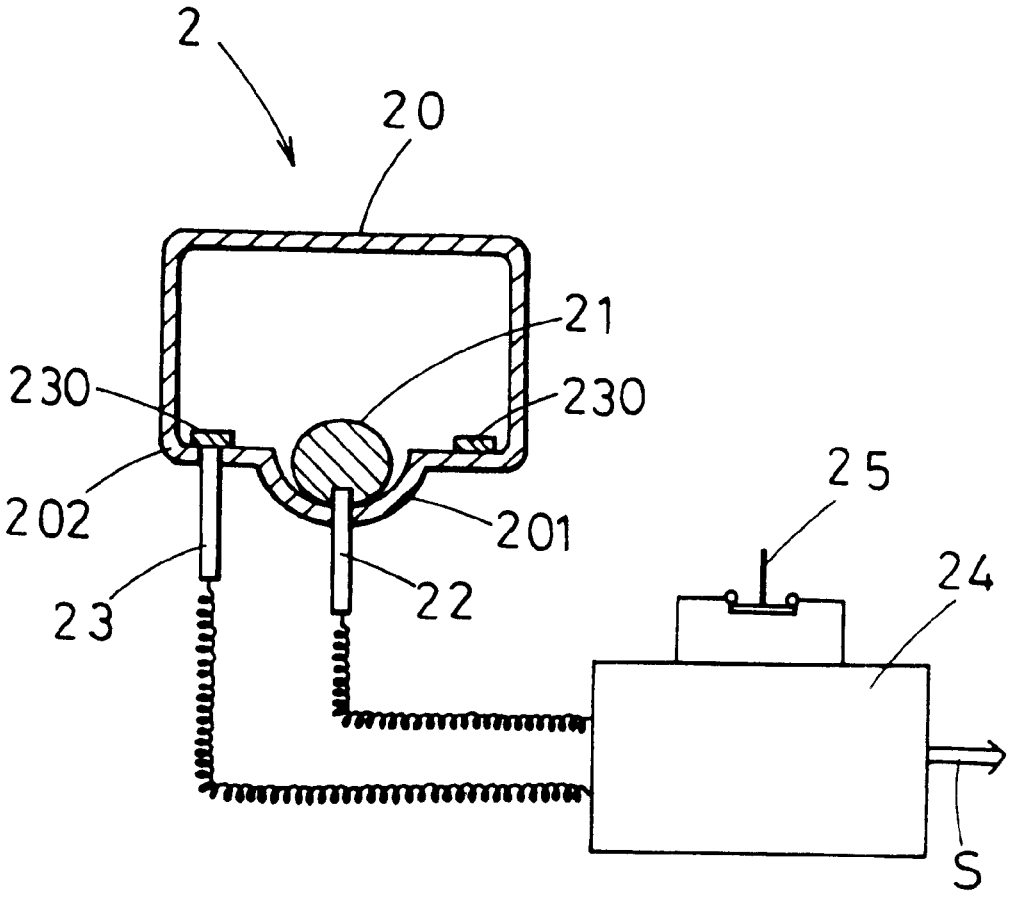
FIG. 2 is a sectional view showing one embodied form of a sensor of the marking device shown in FIG. 1.

The sensor 2 is located at a position in contact with a side wall 40 of the paper money container 4, as shown in FIG. 1, and has a mercury switch structure, as shown in FIG. 2. The sensor 2 comprises a mercury holding portion 20, mercury 21, a center electrode portion 22, a side electrode portion 23, a self-hold circuit 24 and a limit switch 25.

The mercury holding portion 20 is formed by a closed space having a depression 201 for holding the mercury 21 and a flat portion 202. The center electrode portion 22 is provided in a portion of the depression 201, and a ring-shaped mercury contacting element 230 connected with the side electrode portion 23 is provided in the flat portion 202.

The sensor 2 is set in place with the mercury 21 held in the depression 201, as shown in FIG. 2. When the sensor 2 is tilted or shocked by, for example, vibration in excess of a predetermined vibration, the mercury 21 held in the depression 201 is moved out from the depression 201 and is brought into contact with the mercury contacting element 230 to close and complete the self-hold circuit 24 through the side electrode portion 23 so as to transmit detecting signal S to the marking means 3.

The sensor 2 is so designed that it can allow the transmission of detecting signal S to the marking means 3 to be stopped by pressing the limit switch 25 to open and break the self-hold circuit 24.

The marking means 3 is provided with a rotary blade 31 serving as a cutting blade for cutting the paper money C, a rotation motor 32 for rotating the rotary blade 31, and shifting means 33 for shifting the rotary blade 31, as shown in FIG. 1.

The shifting means 33 comprises a feed motor 330, a feed screw 331 and a feed nut 332.

The rotary blade 31 has a saw-toothed cutting edge 310, confronting the paper money C contained in the paper many container 4, and is connected to the rotation motor 32 at a position over the paper money container 4, as shown in FIG. 1.

The shifting means 33 is constructed to allow the feed screw 331 to be rotated by activation of the feed motor 330, so as to shift the feed nut 332 vertically in response to the rotation of the feed screw 331.

The rotation motor 32 is connected with the feed nut 332 of the shifting means 33 so that the rotation motor 32 can be shifted vertically along a traveling rail 36 in response to the movement of the feed nut 332.

Figure 3:
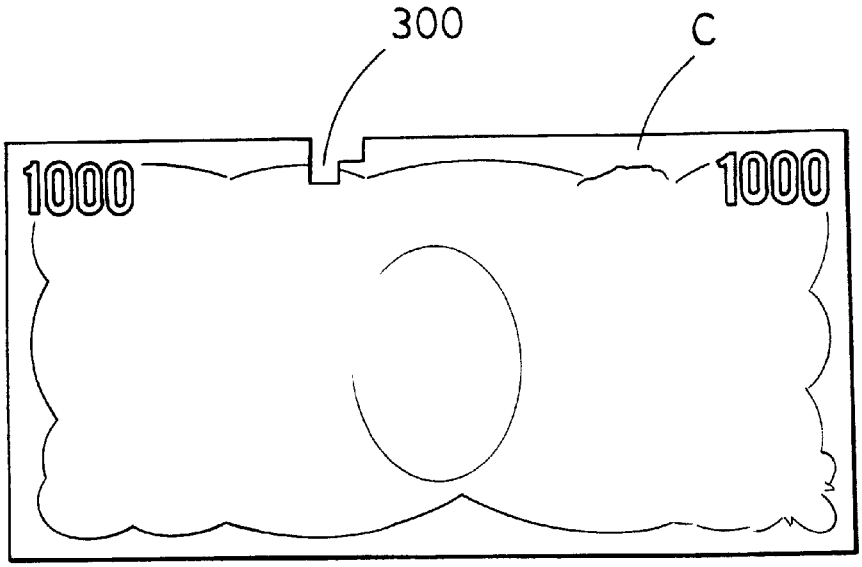
FIG. 3 is a front view showing the paper money marked by the marking device in the theft proof system in accordance with the present invention.

The marking means 3 is put into action when it receives information from the sensor 2. When the marking means is activated, the rotary blade 31 is moved downward, while rotating, to cut part of the paper moneys, so as to provide the mark to the paper moneys C, as shown in FIG. 3.

The paper money container 4 opens at a side thereof facing the rotary blade 31 to prevent the container from being cut by the rotary blade 31.

It should be noted that a battery (not shown) is used as the power source of the marking device 1 in case the external power source is cut off by the robber.

In the following, operation of the marking device will be described.

The marking device 1 is placed in the CD machine in such a manner that the rotary blade 31 is positioned above the paper money container 4 for containing the paper money C, as shown in FIG. 1.

The sensor 2 in the marking means 3 of the marking device 1 is set with the mercury 21 in the mercury holding portion 20 held in the depression 201, as shown in FIG. 2. In other words, the sensor is set in the state in which no detecting signal S is transmitted.

As long as the CD machine is used in the common manner, the marking device 1 thus set is not put into action and the CD machine using the marking device of the invention operates in no different manner from the common CD machine.

However, when the CD machine using the marking device 1 is shocked in an unordinary manner by tilt, vibration and the like caused by fraudulent acts, such as an act of the CD machine being lifted with a pry bar or other like tools to take away the CD machine as a whole, the mercury 21 in the depression 201 of the sensor 2 built in the marking device 1 is moved out from the depression 201 and is brought into contact with the mercury contacting element 230.

After the mercury 21 contacts with the mercury contacting element 230 for only a moment, the self-hold circuit 24 allows the detecting signal S to be transmitted to the marking means 3 through the side electrode portion 23, even after the mercury 21 returns to the original position in the depression 201.

Since the detecting signal S serves as a power signal for actuating the marking means 3, when the detecting signal S is transmitted to the marking means 3, the marking means 3 is put in action.

The marking means 3 uses the feed motor 330 and the rotation motor 32 as the power source.

When the feed motor 330 is put into action, it drives the feed screw 331 to rotate, which in turn allows the feed nut 332 to move downward in response to the rotation of the feed screw 331. The rotation motor 32 allows the rotary blade 31 to rotate.

Thus, the marking means 3 allows the rotating rotary blade 31 to move downward to cut the paper moneys C in the paper money container 4 partially with the rotating rotary blade, as shown in FIG. 1.

The paper moneys C contained in the paper money container 4 are partially cut with the rotary blade 31 and thereby are each given a mark 300, as shown in FIG. 3.

The mark 300 given to the paper money C draws ones attention very much when circulated and thus makes it very hard to circulate the marked paper money. Also, the paper money C thus marked is rebuffed by a money change machine, an automatic vending machine and the like, without being accepted by them. In addition, the marking pattern of the mark 300 allows the origin of the marked paper money to be envisaged with ease.

It is needless to say that the marking means 3 may be made inactive in advance by means of the limit switch 25, for performing normal activities such as, for example, additionally supplying the paper money C into the paper money container 4 or moving the CD machine having the marking device 1 therein to another place.

Thus, even when the paper money C is stolen from the CD machine having the marking device 1 therein, since the paper money C is given the mark 300, the marked paper money C can be easily traced back shortly after they are circulated by the robber(s). Besides, it cannot be accepted by a money change machine, an automatic vending machine and the like. As a result of this, the marked paper money C becomes totally useless.

Also, as the marking device 1 becomes widespread and the existence of the marking device built into the CD machine comes to be known to the public, anyone will be disinclined to steal the paper money from the CD machine, and as such can contribute to the prevention of crime.

In addition, since the marking device 1 is designed to cut the paper money C partially with the rotary blade 31, when the marking device built into the CD machine or the like is put into action, it does not mess the interior of the CD machine as much, differently from the ink spraying type marking machine, and can be used repeatedly, besides surely providing the mark to the paper money.

Also, since the use of the rotary blade 31 is the most effective for cutting the paper money, there is no need to reinforce the floor and frame of the paper money container 4, as with other marking ways, such as the boring of the paper money C.

Further, since the paper money C marked by the marking device 1 can be recognized even in a dark place or by a person with bad eyesight or visual problems, the circulation of the marked paper money can surely be prevented.

The marking device in the paper money theft proof system of the present invention is not limited to the above-illustrated form of the marking device 1.

For example, while the marking device 1 is built in the CD machine in the illustrated embodiment, the marking device may be so modified as to be built into other paper money containers than the CD machine, such as automatic vending machines, safes or attache cases.

Take a case of the marking device being built into an attache case, for instance. The marking device is then designed to include a sensor that reacts when the attache case is opened without using a regular key. The attache case thus designed can also allow the paper money to be marked. Accordingly, even when the paper money in this attache case is stolen by force during transport, the paper money can be marked to make the robber(s) disinclined to use the marked paper money.

Accordingly, as the marking device used for the attache case or like cases becomes widespread, so that the existence of the marking device built into the attache case comes to be known to the public, anyone will be disinclined to assault a cash transporting car, and as such the invention contributes to the prevention of crime.

While the rotary blade 31 of the cutting blade is shifted from top to bottom by the feed screw 331 in the above-illustrated embodiment, it may alternatively be shifted from bottom to top.

Figure 4:
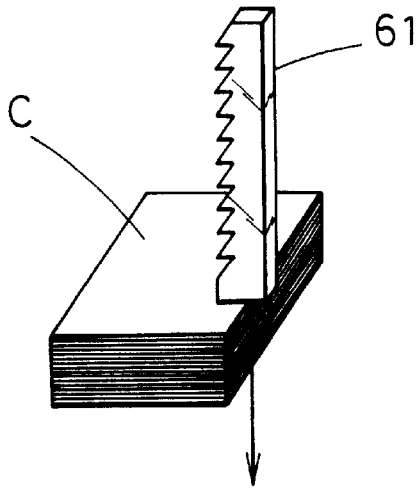
FIG. 4 is a perspective view showing another embodied form of a cutting blade.

Also, the cutting blade may be a straight saw-toothed cutting blade 61, as shown in FIG. 4.

Two or more cutting blades may be used instead of a single cutting blade. More varieties of marking patterns can be formed by the use of two or more cutting blades.

Further, though not shown, a jigsaw-like cutting blade may be used and reciprocally moved vertically to mark the paper money C, or a heating wire may be used and pressed against the paper money C to mark it.

The form or pattern of the marking 300 shown in FIG. 3 can be varied unlimitedly by varying the shape of the cutting edge 310 of the rotary blade 31. Accordingly, the origin of the marked paper money C can be envisaged from the information on the marking pattern in the same principle as, for example, the principle in which a boarding station is envisaged from the information on the punching pattern of a ticket punch.

Further, the marking device of the invention may be so modified as to cut the paper money C at two or more sides thereof, rather than at one side thereof as in the above-illustrated embodiment.

This modification can provide the result that even when a robber(s) tries to use the paper money C through deception by tearing portions of the paper money C around the marks provided by the cutting, he/she/they cannot, because the paper money C will then have to be unnaturally torn at several parts thereof.

While the shifting means 33 is designed to shift the rotary blade 31 by the feed screw 331 and the feed nut 332 in the above-illustrated embodiment, the shifting means may be so modified as to shift the rotary blade 331 such that the paper money C can be cut by only the turning force of the rotary blade 331, without using the feed screw.

Also, the shifting means may be modified so as to shift the cutting edge horizontally, depending on the orientation of the paper money C to be contained.

In addition, a modification may be made in the marking device of the invention by making the rotary blade 31 stationary, while making the paper money container 4 move vertically.

Also, while the sensor 2 is in the form of the mercury switch in the above-illustrated embodiment, the commonly used sensor, such as a limit switch or a proximity switch, may be used instead of the mercury switch.

What is claimed is:

1. A marking device in a paper money theft proof system, comprising:

a sensor that detects a shock produced when a paper money container is moved or broken to take out paper money contained in the paper money container; and a marking means for providing a mark to at least a part of the paper money under control of a signal provided by said sensor, said marking means being constructed as to partially cut the paper money, said marking means comprising:

a rotary cutting blade for partially cutting any side end of the paper money contained in the paper money container; and shifting means for shifting one of said cutting blade and the paper money contained in the paper money container relative to the other in a direction in which the paper money is piled.

2. The marking device of claim 1, wherein said marking blade comprises two or more cutting blades for cutting the paper money.

3. The marking device of claim 1, wherein said cutting blade is arranged so that two or more sides of the paper money can be cut by the cutting blade.

4. The marking device of claim 2, wherein said cutting blades are arranged so that two or more sides of the paper money can be cut by the cutting blades.

5. The marking device of claim 1, wherein said marking means further comprises a rotation motor for rotating the rotary blade.

6. The marking device of claim 1, wherein said sensor is operable to generate the signal and transmit the signal to said marking means when the sensor detects the shock produced when the paper money container is moved or broken to take out paper money contained in the paper money container.

7. The marking device of claim 6, wherein said sensor comprises a circuit that is closed to produce the signal when the shock is produced.

8. The marking device of claim 7, wherein said sensor includes a mercury switch structure, a self-hold circuit and a limit switch.

9. A marking device in a paper money theft proof system, comprising:

a sensor that is operable to detect a shock produced when a paper money container is moved or broken to take out paper money contained in the paper money container, to produce a signal in response thereto and to transmit said signal; and a marking device that is positioned and operable to receive said signal from said sensor and to mark the paper money contained in the paper money container by partially cutting the paper money when said sensor produces and transmits said signal, wherein said marking device comprises a rotary cutting blade.

10. The marking device of claim 9, wherein said cutting blade is positioned so as to partially cut a side end of the paper money contained in the paper money container and a shifting device operable to shift said cutting blade relative to the paper money contained in the paper money container in a direction in which the paper money is piled.

11. The marking device of claim 9, wherein said marking device further comprises a rotation motor for rotating the rotary blade.

12. The marking device of claim 9, wherein said sensor comprises an electrical circuit to produce said signal when the shock is produced.

13. The marking device of claim 12, wherein said sensor includes a mercury switch structure, a self-hold circuit and a limit switch.

14. The marking device of claim 9, wherein said signal produced by said sensor is an electrical signal.

* * * * *